United States Patent [19]

Filippini et al.

[11] 4,204,683

[45] May 27, 1980

[54] DEVICE AND METHOD FOR DETECTION OF THE SHOTS ON A TARGET FROM A DISTANCE

[76] Inventors: Gennaro Filippini; Alfredo Filippini, both of Via di Jano n. 6, Bologna, Italy

[21] Appl. No.: 783,331

[22] Filed: Mar. 31, 1977

[30] Foreign Application Priority Data

Nov. 18, 1976 [IT] Italy ..... 3591 A/76

[51] Int. Cl.[2] ..... F41J 5/04

[52] U.S. Cl. ..... 273/371

[58] Field of Search ..... 273/101.1, 102.2 R, 273/102.2 B, DIG. 28, 183 R, 184 R, 185 R, 185 A, 186 R; 35/25; 89/41 L; 340/323 R; 358/93, 125

[56] References Cited

U.S. PATENT DOCUMENTS

| | | | |
|---|---|---|---|
| 3,216,726 | 11/1965 | Andersen et al. | 273/185 R X |
| 3,275,744 | 9/1966 | Dietrich | 358/93 |
| 3,590,225 | 6/1971 | Murphy | 273/102.2 R X |
| 3,623,065 | 11/1971 | Rockwood et al. | 273/102.2 R X |
| 3,624,401 | 11/1971 | Stoller | 273/102.2 B X |
| 3,727,069 | 4/1973 | Crittenden et al. | 273/102.2 B X |
| 3,793,481 | 2/1974 | Ripley et al. | 273/DIG. 28 |
| 3,838,856 | 10/1974 | Takeya et al. | 273/101.1 |
| 3,903,361 | 9/1975 | Alpers | 358/125 |
| 3,944,738 | 3/1976 | Johnson | 273/DIG. 28 |
| 4,004,083 | 1/1977 | Norem | 358/125 |
| 4,005,261 | 1/1977 | Sato et al. | 273/183 R X |
| 4,015,258 | 3/1977 | Smith et al. | 89/41 L |

*Primary Examiner*—Vance Y. Hum

*Attorney, Agent, or Firm*—Martin A. Farber

[57] ABSTRACT

A device and method for detection of the shots on a target comprising a closed video circuit with the camera positioned adjacent the target so as to receive light influenced by a projectile about to hit the target. The monitor of the video circuit is positioned adjacent to the shooter and provides indication of the shooter's shot on the monitor.

4 Claims, 1 Drawing Figure

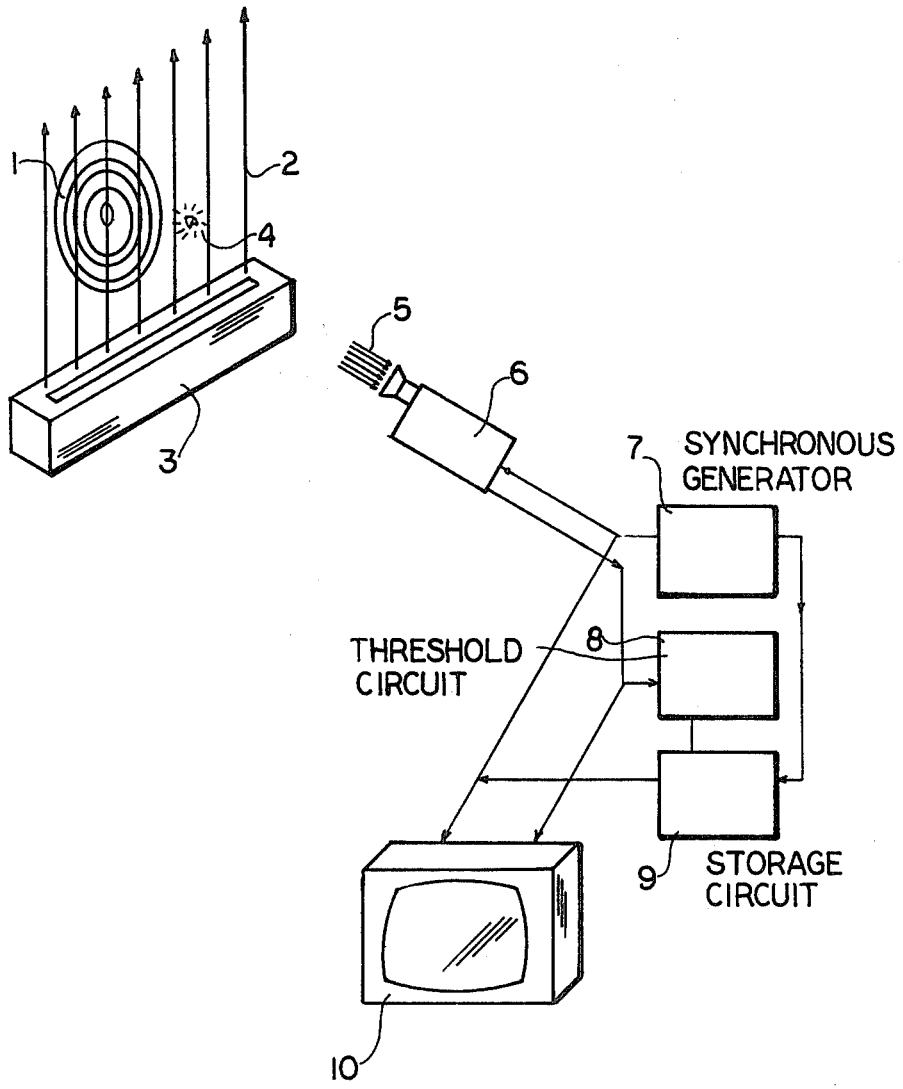
1
2
4
3
5
6
7
SYNCHRONOUS GENERATOR
THRESHOLD CIRCUIT
8
9
STORAGE CIRCUIT
10

DEVICE AND METHOD FOR DETECTION OF THE SHOTS ON A TARGET FROM A DISTANCE

The present invention relates to an improvement in a system of detecting the shots existing on a target from a distance, the target which may be a target disc for shooting with pistols, rifles, bow and arrow and the like.

In Italian patent application No. 3304 A/76, here a part of the present invention, the target was placed upon a sensitive support on which the arrival position of the projectile was located by means of coordinates which divided the support by sensitized areas.

It is evident, however, that the system could only be used in cases in which the bullets had a low momentum so that the energy set free by the impact was not so great as to damage the detecting device itself; in fact, by using projectiles with high momentum the detecting device would be destroyed within a very short time.

It is an object of the present invention to provide a method of detection and a detecting system which—even of the same concept as that of the introductory mentioned type, may be used without damage thereto, also in those cases, in which projectiles of high energy are shot, such as for example high caliber bullets, arrows, etc.

With this, a system of coordinates is still used, which are, however, associated without a massive target without discontinuities. The target, to which small cards with numbered zones for the scoring are fixed, is sufficiently strong to resist various successive shots.

Instead of small mobile areas providing for the sensitive part, a videocamera is used, which is connected to a closed circuit television, the monitor of which is placed near the shooter.

The videocamera instead of registering the image of the impact point of the projectile, registers the reflex product by the bullet when crossing the light rays which are positioned in front of the target and parallel thereto.

In this way, even in the hypothetical, but practically not too rare, case of shots which are located one over the other in the same spot, successive registrations are obtained in such a manner as if each single shot had arrived alone and distinctly on the target. A convenient system for storing and transmitting the registered data permits the reading and the visualization of the single shot as well as of all the shots by the shooter, by means of a monitor placed near the firing line.

The device which the present invention relates to works substantially in the following way: the system of coordinates placed over the target utilizes the same principle as that which provides an image in TV picture tubes; the area is scanned by lines and within each line, by points, thus obtaining perpendicular Cartesian coordinates.

With the proper lighting conditions, the bullet upon crossing a light ray, by means of reflection of the luminous rays, creates an intensely contrasting image on the tube of the videocamera and as the area involved with this image is explored by the scanning ray, a signal is obtained with a white level which is superior to that of all other observed parts. This signal is registered by a suitable threshold circuit, which is sensitive to the fact that a signal has been produced which is clearly distinct from all others of the background. The release of the threshold circuit is used to fix or ascertain the elapsed time between the beginning of the scanning of the frame and the release, within a storage device. In formation of the frames following the one in which the examined event occurred, it is sufficient to insert a white level signal within the time indicated by the storage in order to obtain a permanent indication of the projectile impact point.

Clearing may be accomplished simply by setting the storage circuit to zero during the elapsed time between the beginning of the frame and the tracing of the shot.

In order to increase the sensitivity of the registration; convenient lighting procedures in the zone in front of the target are to be used, so that the traversal of the projectile are to be used so that the passing of the projectile will generate a sufficiently distinct flash.

With the above and other objects and advantages in view, the present invention will become more clearly understood in connection with the detailed description of a preferred embodiment, when considered with the accompanying drawing, of which the only FIGURE illustrates in a schematic way one form of carrying out the invention showing a target and monitoring circuit, partly in perspective and block diagram view.

A target 1 is disposed behind a parallel path of light rays 2 coming from a luminous source 3. A projectile 4 on crossing a portion of the light ray path 2 reflects rays 5 toward videocamera 6, which are "read" by the videocamera 6. The signals of the camera 6 are elaborated in the following by a synchronous generator 7, a threshold circuit 8 and a storage circuit 9 connected to each other as indicated, and having an outlet feeding into a TV monitor 10.

In this manner, an indication registering on the target is elaborated and transmitted from a distance near the shooter.

While we have disclosed one embodiment of the invention it is to be understood that this embodiment is given by example only and not in a limiting sense.

We claim:

1. A system for detecting the shots of a shooter present on a solid, material target having a substantially flat surface from a distance, comprising a solid stationary target having a substantially flat surface capable of being permanently marked, a closed video circuit having only one video camera, a memory storage circuit and a television viewing monitor operatively connected together, said camera being positioned adjacent to the target so as to receive light being influenced by a projectile about to hit the target, said monitor being positioned adjacent the shooter and operatively connected to said camera so that the shooter can see an indication of the shot on the target via said monitor, light source means for providing a track of light substantially defining a two dimensional area comprising parallel paths of light rays adjacent to, in parallel to and spaced in front of the target not impinging said flat surface thereof, said light source means comprises a rectangular member formed with a single elongated longitudinal slot, said track of light originating through said longitudinal slot, said camera having an optical axis being positioned facing said track of light and said flat surface so as to receive light reflected by the projectile while crossing the track of light as the projectile is about to hit the target, said parallel paths of light rays extending non-parallel and substantially perpendicularly to said optical axis of said camera, whereby when the projectile crosses the track of light before hitting the adjacent target a representation of the target impact site appears on the viewing monitor.

2. The system as set forth in claim 1, wherein said closed video circuit includes means for scanning an image in lines and points such that the projectile is located by a system of right-angled coordinates.

3. The system as set forth in claim 1, wherein said closed video circuit includes elaborating means for storing and transmitting data registered in the closed video circuit by a singular as well as simultaneous projectiles about to hit the target.

4. A method for detecting the shots of a shooter on a target from a distance, comprising the steps of providing a planar track of light substantially defining a two dimensional area comprising parallel paths of light rays parallel to, spaced therefrom and adjacent in front of a substantially flat surface of the target without impinging on the target by passing light through a single elongated longitudinal slot in a rectangular member, the track of light originating through the longitudinal slot, and placing a system of Cartesian coordinates over the target by scanning lines, and scanning points within the lines, disposing a video camera having an optical axis adjacent to and facing the target, said parallel paths of light rays extending non-parallel and substantially perpendicularly to said optical axis of said camera, reflecting the light into the video camera by shooting at least one projectile toward the target crossing the track of light before hitting the target, providing a video processing via a closed video circuit having only one video camera, a memory storage circuit and a television viewing monitor operatively connected together, transmitting the reflected light from the camera onto the television monitor positioned adjacent the shooter, whereby when the projectile crosses the track of light before hitting the adjacent target a representation of the target impact site appears on the viewing monitor, so that the shooter can see an indication of the shot on the target.

* * * * *